US006422155B1

(12) United States Patent
Heyden et al.

(10) Patent No.: US 6,422,155 B1
(45) Date of Patent: Jul. 23, 2002

(54) RAIL CAR TRUCK PEDESTAL SHEAR PAD

(75) Inventors: Thomas J. Heyden, Arlington Heights; Wilson W. S. Pak, Park Ridge; Armand P. Taillon, Chicago, all of IL (US)

(73) Assignee: Standard Car Truck Company, Park Ridge, IL (US)

( * ) Notice: Subject to any disclaimer, the term of this patent is extended or adjusted under 35 U.S.C. 154(b) by 0 days.

(21) Appl. No.: 09/677,750

(22) Filed: Oct. 3, 2000

(51) Int. Cl.[7] ..... B61F 5/12
(52) U.S. Cl. ..... 105/225; 105/222; 105/224.1
(58) Field of Search ..... 105/225, 198.2, 105/222, 224.1

(56) References Cited

U.S. PATENT DOCUMENTS 4,203,371 A * 5/1980 Tack ..... 105/225
4,785,740 A * 11/1988 Grandy ..... 105/225
4,938,152 A * 7/1990 List ..... 105/224.1
5,425,312 A * 6/1995 Tack, Jr. ..... 105/225
5,799,582 A * 9/1998 Rudibaugh et al. ..... 105/222
5,924,366 A * 7/1999 Trainer et al. ..... 105/225
6,178,894 B1 * 1/2001 Leingang ..... 105/224.1
6,234,083 B1 * 5/2001 Tack, Jr. ..... 105/225

* cited by examiner

*Primary Examiner*—S. Joseph Morano
*Assistant Examiner*—Lars A. Olson
(74) *Attorney, Agent, or Firm*—Cook, Alex, McFarron, Manzo, Cummings & Mehler, Ltd.

(57) ABSTRACT

A rail car truck has a pair of side frames, connected by a bolster, with the side frames each having pedestals at the opposite ends thereof which are designed to seat upon roller bearing adapters which are supported on the rail car truck wheel sets. Shear pads are positioned between each of the side frame pedestals and the corresponding roller bearing adapter. The shear pads include notches designed to interlock with projections on each side frame pedestal and notches designed to interlock with projections on each roller bearing adapter, whereby the shear pad is interlocked to both the side frame pedestal and the roller bearing adapter, preventing relative movement between the shear pad and the side frame pedestal and between the shear pad and roller bearing adapter in a direction parallel with the longitudinal dimension of the side frame.

1 Claim, 2 Drawing Sheets

Fig. 1.
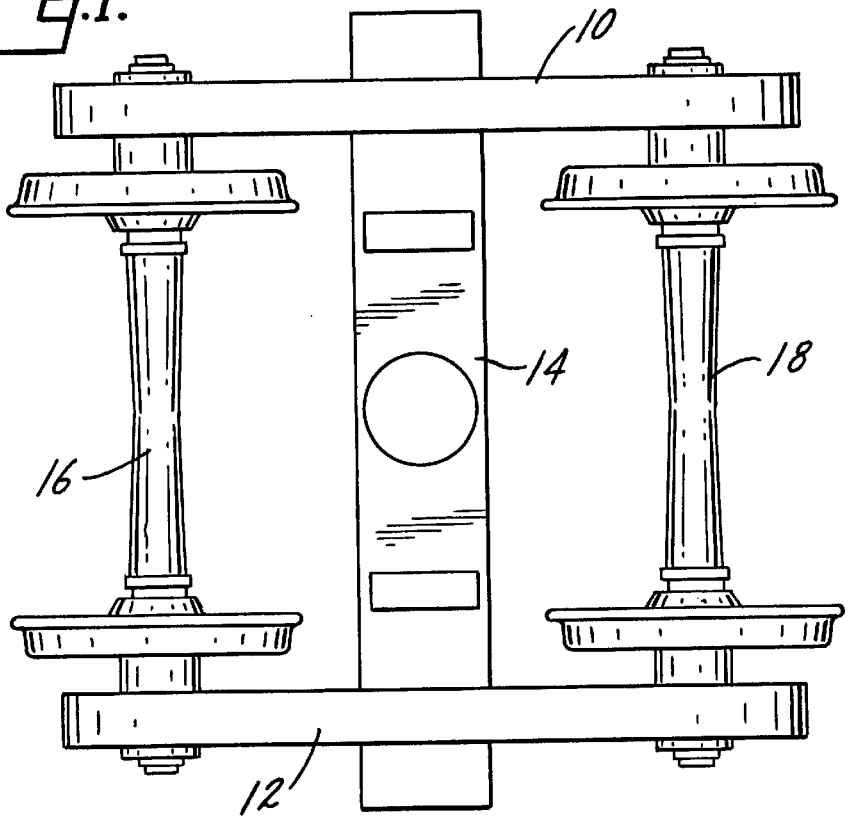
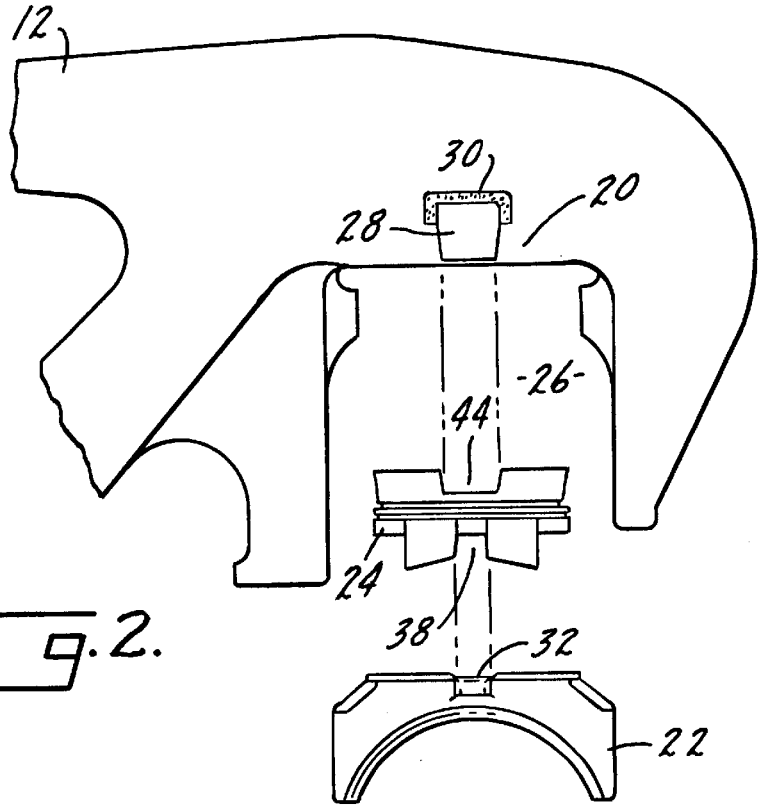
Fig. 2.

RAIL CAR TRUCK PEDESTAL SHEAR PAD

THE FIELD OF THE INVENTION

The present invention relates to rail car truck shear pads which are conventionally used to support side frame pedestals on roller bearing adapters, with the adapters customarily supporting the rail car truck side frames on the truck wheel sets. Typically, such shear pads are not interlocked with or secured to the side frame pedestal or the roller bearing adapter in a manner which would prevent movement of these elements relative to each other in a direction parallel to the longitudinal dimension of the side frame. By securing the shear pads to both the roller bearing adapter and the side frame pedestal, the speed at which a rail car truck hunts will be substantially increased.

Typical shear pads used in the described environment in the past have tended to slip at the interfaces between the shear pad and the side frame pedestal and between the shear pad and the roller bearing adapter. When such slippage occurs, the effective stiffness of the shear pad is greatly reduced and hunting is initiated. The stiffness of the shear pad greatly affects truck inter-axle shear stiffness. As the inter-axle shear stiffness increases, the threshold of truck hunting rises. Thus, shear pad slipping instantaneously reduces the effective inter-axle shear stiffness of the rail car truck. By interlocking the shear pad to both the side frame pedestal and the roller bearing adapter, it is possible to substantially increase the speed at which truck hunting occurs.

SUMMARY OF THE INVENTION

The present invention relates to rail car trucks and in particular to an improved shear pad for supporting the side frame pedestals on the related roller bearing adapters.

A primary purpose of the invention is a shear pad for the described environment which has formed thereon structure which enables the shear pad to be interlocked with both the side frame pedestal and the roller bearing adapter.

Another purpose of the invention is to provide a shear pad for the use described in which there are a plurality of steel plates encapsulated by an elastomeric material and in which the shear pad is interlocked with both the roller bearing adapter and the side frame pedestal, preventing relative movement between these elements in the direction of the longitudinal dimension of the side frame.

Other purposes will appear in the ensuing specification, drawings and claims.

BRIEF DESCRIPTION OF THE DRAWINGS

The invention is illustrated diagrammatically in the following drawings wherein:

FIG. 1 is a top plan view of a rail car truck illustrating the various components thereof;

FIG. 2 is a partial exploded side view of the side frame, shear pad and roller bearing adapter forming a part of the rail car truck of FIG. 1;

DESCRIPTION OF THE PREFERRED EMBODIMENT

Figure 3:
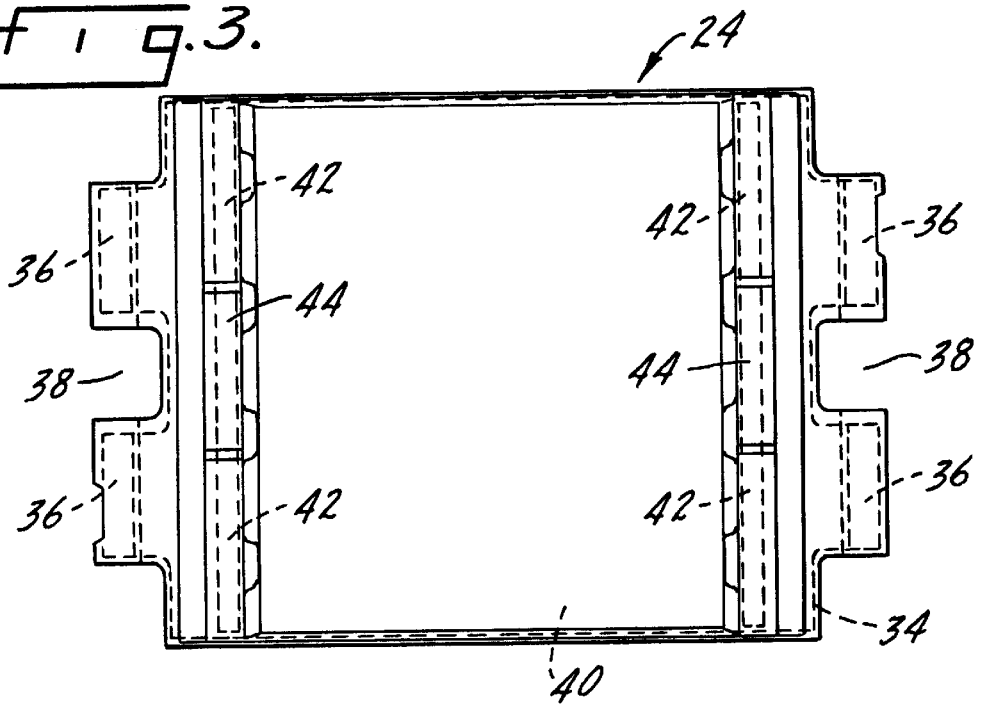
FIG. 3 is a top plan view of the shear pad.

The hunting of rail car trucks is a known phenomenon in the railroad industry and numerous and continuing efforts are made to increase the threshold speed at which a rail car truck will begin to hunt. Hunting can cause damage to both the track and the rail car truck components, as well as derailment. Thus, raising the threshold at which hunting can occur permits railroads to operate safely at higher speeds. The present invention is specifically directed to the inter-axle shear stiffness which is substantially affected by the shear pad supporting the side frame on the roller bearing adapter.

The present invention more specifically provides an interlock between the shear pad and the side frame pedestal which it supports and an interlock between the shear pad and the roller bearing adapter on which the shear pad is seated. By increasing shear stiffness, which is accomplished by the described interlocks, the threshold of truck hunting rises and thus increases the speed at which the truck may be safely operated. The stiffness of the shear pad greatly affects truck inter-axle shear stiffness and thus by reducing the potential for relative movement between the side frame pedestal and the shear pad and the side frame pedestal and the roller bearing adapter, inter-axle shear stiffness is increased and the hunting threshold rises. The described interlock effectively eliminates slipping of the shear pad between the described components which has the effect of raising the effective inter-axle shear stiffness.

In FIG. 1, a rail car truck includes a pair of side frames 10 and 12 connected together by a bolster 14. Wheel sets 16 and 18 support the side frames and there will be roller bearing adapters between each of the wheel sets and the side frame pedestals. FIG. 2 illustrates the side frame pedestal at 20, the roller bearing adapter at 22 and the shear pad at 24.

The side frame pedestal 20 has an opening 26 within which will be positioned the shear pad 24 and the roller bearing adapter 22 as it is mounted on one of the described wheel sets. The side frame pedestal may have steel blocks 28 attached, as by welds 30, to opposite sides thereof in alignment with notches, to be described, on the shear pad. Similarly, the roller bearing adapter 22 may have outwardly extending projections 32, extending laterally from both sides of the roller bearing adapter, which laterally extending projections will interlock with notches on the shear pad 24. The interlock described between the shear pad and both the side frame pedestal and the roller bearing adapter prevents relative movement between these elements in a direction parallel to the longitudinal dimension of the side frame as the side frame is depicted in FIG. 1.

Figure 4:
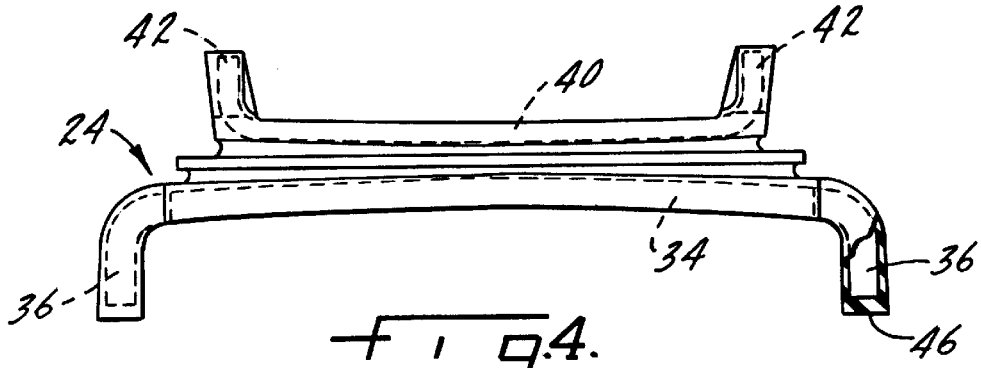
FIG. 4 is a front view of the shear pad as illustrated in FIG. 3.
Figure 5:
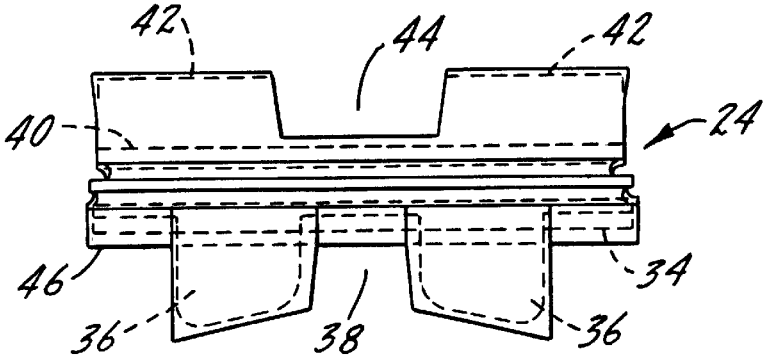
FIG. 5 is a side view of the shear pad as illustrated in FIG. 3.

The shear pad 24 is illustrated in detail in FIGS. 3, 4 and 5. There is a lower steel plate 34, which may have a slight convex configuration, and which has down-turned edges 36 which will permit the shear pad to closely fit upon the top of the roller bearing adapter 22. The down-turned edges 36 each have a generally central notch 38 which is of a size and configuration to interlock with a laterally extending projection 32 on the roller bearing adapter 22. This interlock prevents relative movement between the shear pad and the roller bearing adapter in a direction parallel to the longitudinal dimension of the side frame.

The shear pad 24 may have an upper plate 40 which has up-turned edges 42, as particularly shown in FIG. 4. The up-turned edges 40 each have a generally central notch 44, as shown in FIG. 5, with the notches 44 being formed and adapted to interlock with and receive the welded projections 28 on the side frame pedestal 20. This arrangement of components interlocks the shear pad with the side frame pedestal.

The shear pad 24, with the described plates, may be completely encapsulated within an elastomeric or rubberlike material indicated generally at 46 in FIG. 4. Shear pads having the described elastomeric encapsulation of steel plates are known in the art. What is not known is the provision of an interlock between the upper and lower shear pad plates and the side frame pedestal and the roller bearing adapter. In this connection, the interlock between the shear pad and the roller bearing adapter utilizes the bearing adapter lifting lugs which are the projections 32 indicated in FIG. 2. The steel blocks 28 which are welded to the side of the side frame pedestal are an additional component, whereas, the lifting lugs are standard in the art.

Both the notches on the upper extending edges and the lower extending edges of the shear pad and the size of the projections 28 and the lifting lugs on the roller bearing adapter are designed so that they will tightly fit at a minimum material condition. The steel plates of the shear pad are designed to bend around the lugs and the blocks to accommodate the maximum material condition. This is necessary because the lug on the roller bearing adapter is not a tightly toleranced part.

Whereas the preferred form of the invention has been shown and described herein, it should be realized that there may be many modifications, substitutions and alterations thereto.

The embodiments of the invention in which an exclusive property or privilege is claimed are defined as follows:

1. In combination, a rail car truck side frame having a pedestal, a roller bearing adapter for use with the side frame in supporting the side frame on a rail car truck wheel set, and a shear pad positioned on top of the roller bearing adapter and supporting the side frame pedestal, said shear pad including an upper plate and a lower plate, said plates being layered together and encapsulated with an elastomeric material, interlocking means on the shear pad and the roller bearing adapter preventing relative movement therebetween in a direction parallel with a longitudinal dimension of the side frame, including projections extending outwardly from the roller bearing adapter and in a direction generally perpendicular to the longitudinal dimension of the side frame, said shear pad lower steel plate having down-turned edges parallel to the side frame, which down-turned edges extend about the roller bearing adapter when the shear plate is seated on the roller bearing adapter, notches in said down-turned edges, with said roller bearing adapter projections extending into said notches, and interlocking means on the side frame pedestal and shear pad preventing relative movement therebetween in a direction parallel with the longitudinal dimension of the side frame including a pair of projections extending laterally outwardly from the side frame pedestal, said shear pad upper plate having up-turned edges parallel to the side frame formed and adapted to seat the side frame pedestal, notches in said upper plate up-turned edges, which notches receive the laterally extending projections from the side frame pedestal.

* * * * *